US009137871B2

(12) United States Patent
Bakk et al.

(10) Patent No.: US 9,137,871 B2
(45) Date of Patent: Sep. 15, 2015

(54) METHOD AND CIRCUIT ARRANGEMENT FOR PRODUCING MIXED LED LIGHT OF A PREDETERMINED COLOR

(75) Inventors: Istvan Bakk, Törökbalint (HU); Hans Hoschopf, Jennersdorf (AT); Peter Pachler, Graz (AT)

(73) Assignee: Tridonic Jennersdorf GmbH, Jennersdorf (AT)

( * ) Notice: Subject to any disclaimer, the term of this patent is extended or adjusted under 35 U.S.C. 154(b) by 527 days.

(21) Appl. No.: 13/508,282

(22) PCT Filed: Jun. 16, 2010

(86) PCT No.: PCT/EP2010/058479
§ 371 (c)(1),
(2), (4) Date: Jun. 6, 2012

(87) PCT Pub. No.: WO2011/054547
PCT Pub. Date: May 12, 2011

(65) Prior Publication Data

US 2012/0248995 A1 Oct. 4, 2012

(30) Foreign Application Priority Data

Nov. 9, 2009 (DE) ..... 10 2009 052 390

(51) Int. Cl.
*H05B 33/08* (2006.01)

(52) U.S. Cl.
CPC ..... *H05B 33/0857* (2013.01)

(58) Field of Classification Search
None
See application file for complete search history.

(56) References Cited

U.S. PATENT DOCUMENTS

| | | | | |
|---|---|---|---|---|
| 5,939,839 | A | 8/1999 | Robel et al. | |
| 7,872,621 | B2 * | 1/2011 | Lee | 345/82 |
| 2004/0066142 | A1 * | 4/2004 | Stimac et al. | 315/50 |
| 2007/0171159 | A1 | 7/2007 | Lee | |
| 2009/0085503 | A1 | 4/2009 | Narita et al. | |
| 2011/0068701 | A1 * | 3/2011 | Van de Ven et al. | 315/185 R |

FOREIGN PATENT DOCUMENTS

| | | | |
|---|---|---|---|
| DE | 10040155 | A1 | 3/2002 |
| DE | 10329367 | A1 | 10/2004 |
| EP | 2066149 | A2 | 3/2009 |

OTHER PUBLICATIONS

International Preliminary Report on Patentability in connection to corresponding International Application No. PCT/EP2010/058479 on May 15, 2012.
International Search Report issued in connection with the corresponding International Application No. PCT/EP2010/058479 on Sep. 29, 2010.

* cited by examiner

*Primary Examiner* — Douglas W Owens
*Assistant Examiner* — Dedei K Hammond
(74) *Attorney, Agent, or Firm* — The H.T. Than Law Group

(57) ABSTRACT

The invention relates to a method for operating a range of LEDs preferably fed with constant current, which range of LEDs preferably generates white mixed light with at least two LED types of different spectrum, wherein the movement of the color locus of the mixed light, which is caused by the different negative gradients of the temperature dependencies of the intensity of at least two different LED types, is reduced by circuitry without using measurements and feedback variables.

12 Claims, 3 Drawing Sheets

METHOD AND CIRCUIT ARRANGEMENT FOR PRODUCING MIXED LED LIGHT OF A PREDETERMINED COLOR

BACKGROUND OF THE INVENTION

The present invention relates to a method and a circuit arrangement for producing mixed light of a predetermined colour by mixing of light with a longer wavelength being emitted by at least one first LED with light with a shorter wavelength being emitted by at least one second LED. The boundary between the light with a longer wavelength and the one with a shorter wavelength can be e.g. at 500 nm (regarding to the spectrum peak).

It is known to produce mixed light of a predetermined colour by mixing light emitted by at least two LEDs, the light emitted by the one LED and the light emitted by the other LED having different wavelengths. White light can for example be produced by mixing the light emitted by a red light LED and the light emitted by a colour-converted blue light LED (this is e.g. an LED chip producing blue light or UV light which is covered by a phosphor film converting the blue light or the UV light into light with a longer wavelength having a corresponding different colour).

Alternatively white light can be produced by RGB (red, green, blue) mixing.

However, there occurs a problem in that, the colour locus of the mixed light in the CIE chart changes along with the temperature. A cause for the temperature change can be fluctuations of the ambient temperature, but also that the LED module warms up due to the operating current with the elapse of time. In the latter case a steady state is achieved only once a certain warm up time has passed. Generally this is at least 10 minutes, but can be considerably longer.

Temperature changes result in colour locus changes of the mixed light for the following reason: The higher the temperature within an LED module raises the lower is the intensity of the light emitted by the LED (with constant current through the LED). The intensity curve in dependency of the temperature is sloping—or in other words—the gradient is negative. As such, this would not be a problem in itself regarding to the colour of the mixed light, if the gradient of the LED light with the longer wavelength and that of the LED light with the shorter wavelength were the same. Actually, the negative gradient of light with longer wavelengths is greater than the negative gradient of LED light with shorter wavelengths resulting in a variation in the spectrum of the mixed light.

Thus, a typical warming up of an LED module e.g. from room temperature to 60° C. to 80° C. can result in a colour locus shift which is perceptible by the human eye.

SUMMARY OF THE INVENTION

The invention has as its object to counteract the described disadvantageous phenomenon.

The object is achieved by the features of the independent claims. The dependent claims further develop the central idea of the invention in a particularly favourable way.

In a first aspect the invention suggests a method of operating a range of LEDs preferably fed with constant current, preferably generating white mixed light with at least two LED types of different spectrum. Here, the movement of the colour locus of the mixed light, which is caused by the different negative gradients of the temperature dependencies of the intensity of the at least two different LED types, is reduced by circuitry without using measurements and feedback variables.

A compensation for different negative gradients of the temperature dependencies of the intensity can also be achieved by a circuit branch which is preferably passive and in parallel to at least a portion of the range of LEDs, the current curve of which has an essentially inverse temperature gradient regarding to the intensity variation to be compensated for.

The circuit branch may comprise at least one passive temperature-dependent component, in particular a PTC and/or NTC resistor.

The PTC resistor or the NTC resistor may be a part of a network (R1, R2, PTC) for controlling a transistor (T), the base-emitter path (or drain-source path) of which is within the circuit branch.

The circuit branch may be connected in parallel to a portion of the range of LEDs including only one type of LEDs or including several different types of LEDs.

The LEDs of the first type (LED(r)) and of the second type (LED(b)) may be connected in series or in parallel.

The first LED type (LED(r)) may be an optionally colour-converted red, amber-coloured, orange or infra-orange LED.

The second LED type (LED(b)) may be an optionally colour-converted blue light LED or UV-light LED.

The invention also relates to an operating circuit for a range of LEDs preferably fed with constant current, which range of LEDs comprises at least two LED types of different spectrum for producing preferably white mixed light, comprising: a compensation circuit for reducing the movement of the colour locus of the mixed light, which is caused by the different negative gradients of the temperature dependencies of the intensity of the at least two different LED types, wherein the compensation circuit comprises a circuit branch preferably passive and connected in parallel to at least a portion of the range of LEDs, the current curve of which has an essentially inverse temperature gradient regarding to the intensity variation to be compensated for.

The invention further relates to an LED module comprising such an operating circuit having a constant current source and a range of LEDs fed by the same.

Finally the invention also relates to an LED lamp, in particular for white light, comprising at least one such module. The LED lamp may be a retrofit LED lamp designed as a replacement e.g. of bulbs, compact gas discharge lamps or halogen lamps and comprising corresponding mechanical and electrical connections.

Further features, advantages and characteristics of the invention shall be explained now with reference to the figures and accompanying drawings.

DETAILED DESCRIPTION OF THE INVENTION

Hereinafter, LEDs emitting red light (also called "red LEDs") shall represent LEDs with longer wavelengths, while LEDs emitting blue light (also called "blue or colour-converted blue LEDs") shall represent LEDs with shorter wavelengths.

The boundary regarding to the spectrum peak between the light with longer wavelengths and the light with shorter wavelength may e.g. be 500 nm.

Figure 1:
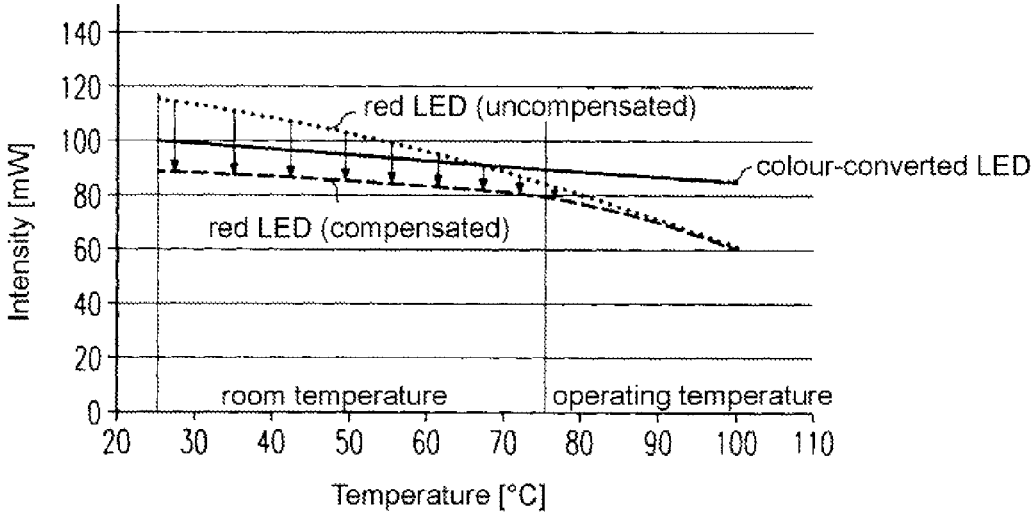
FIG. 1 shows the temperature dependency of the intensity of the light emitted by a red light diode and that of the light emitted by a colour-converted blue light LED.

FIG. 1 illustrates the natural or uncompensated curve of the intensity of the light emitted by red LEDs in dependency of the temperature (of the semiconductor junction) as a dotted curve (each for constant current). The natural or uncompensated curve of the intensity of the light emitted by blue LEDs in dependency of the temperature is illustrated as a solid curve. It can be seen, that both curves drop at a higher temperature, however, the negative gradient of the intensity curve of the red LEDs being greater than that of the intensity curve of the blue LEDs.

In order to be able to produce a white mixed light from the red and the blue (colour-converted where appropriate) LEDs, having a colour locus in the CIE chart which is largely independent of the temperature, the two negative gradients of the two intensity curves should be largely matched. Otherwise fluctuations of the room or ambient temperature or warming up of the LED module to the operating temperature after power on entail an undesired colour shift of the mixed light.

According to the invention this problem is solved by circuitry for compensation control (as opposed to a feedback control) of the intensity curve of the light emitted by red LEDs such that the negative gradient of the light emitted by red LEDs will be reduced such that it will be approximately parallel to the intensity curve of the light emitted by blue LEDs at least until reaching the operating temperature. The compensated intensity curve of the light emitted by the red LEDs is illustrated as a dashed curve.

"Circuitry for control" particularly excludes colour detection by means of a sensor and a feedback signal. Thus, the invention provides for a control circuitry without any control using feedback signals.

Figure 2:
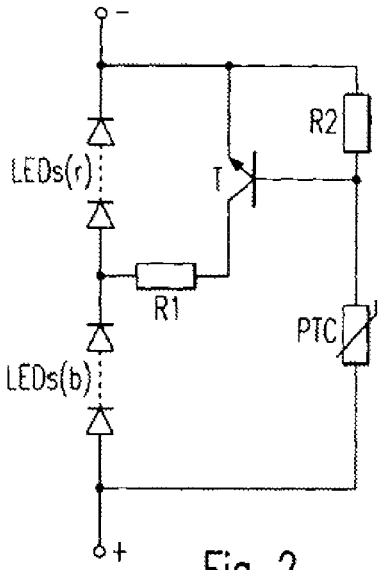
FIG. 2 shows a basic circuit arrangement including a PTC resistor for generating white mixed light by mixing the light emitted by red LEDs and that emitted by colour-converted blue LEDs and a PTC resistor for compensating for the different temperature dependencies of the efficiency of the said two LED types.

FIG. 2 shows a circuit arrangement, by which such compensation may be achieved. This circuit may preferably be fed with regulated constant current whose amplitude of dimming the range of LEDs may be adjustable, e.g. by specifying a default value. The circuit may for example be received within a housing of a retrofit LED lamp.

The circuit arrangement includes plural blue LEDs connected in series and designated as LEDs(b) and plural red LEDs equally connected in series and designated as LEDs(r). A bypass circuit branch consisting of a transistor T and a resistor R1 is connected in parallel to the LEDs(r). A resistor R2 is in parallel to the emitter-base path of the transistor T. In combination with a temperature-sensitive resistor PTC it forms a voltage divider that supplies a control voltage to the emitter of the transistor. The temperature-sensitive resistor PTC has a positive temperature behaviour, i.e. its resistance value rises along with the temperature and vice versa. The temperature-sensitive resistor PTC is in heat conducting contact with the chip or module having arranged at least the LEDs(r). The LEDs(b) may be arranged on this chip or module, too.

When the temperature on the chip or module of the circuit arrangement according to FIG. 1 increases due to an increasing ambient temperature or after power on by the operating heat of the LEDs the resistance of the temperature-sensitive resistor PTC increases as well resulting in lowering the emitter-base voltage of the transistor. This results in the transistor increasingly blocking, thus reducing the partial current flowing through the bypass of the total current. This means that the current flowing through the LEDs(r) will be increased, resulting in the aspirated reduction of the negative gradient of the intensity curve of the light emitted by the LEDs(r).

It goes without saying that the network for generating a control voltage for the transistor T may be designed differently and may or example be realized using a temperature-sensitive component having negative temperature behaviour.

A further option for compensating the intensity curve of the light emitted by the LEDs(r) consists in taking the forward bias of at least one "red" LED and/or at least one "blue" LED, optionally all LEDs in the chain with temporarily stabilized operating current for measuring the temperature ("red" and "blue" are only taken as examples for the first or second types). By evaluating the measured forward bias one can obtain a control parameter for the increase of the operating current.

Figure 3:
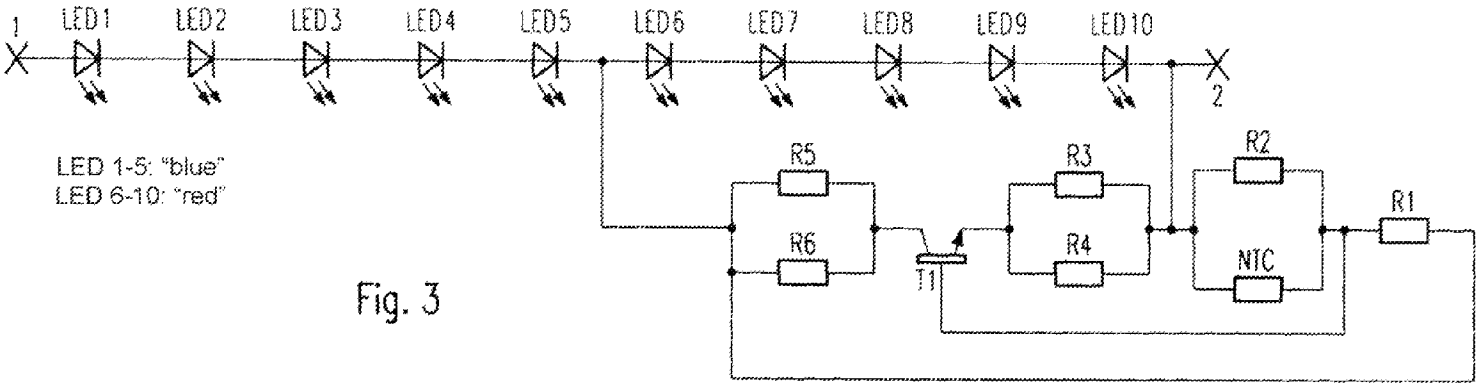
FIG. 3 shows a modification of an example embodiment of FIG. 2 using an NTC resistor in place of the PTC resistor.

FIG. 3 shows a circuit arrangement, by which the compensation described above may be achieved as well. The circuit arrangement includes plural blue LEDs designated as LEDs (b) connected in series and plural red LEDs designated as LEDs(r) connected in series as well. In this embodiment a bypass circuit branch is connected in parallel to the LEDs(r), which, however, comprises an NTC having negative temperature behaviour in place of a PTC, i.e. its resistance decreases along with the temperature and vice versa. In this embodiment as well, the temperature-sensitive resistor NTC is in heat conducting contact with the chip or module having arranged at least the LEDs(r). The LEDs(b) may be arranged on this chip or module, too.

The three components of the entity R1-NTC-R2 deliver temperature-independent current and temperature-independent voltage to the base of the transistor T1, wherein the resistor R1 with the resistor R2 connected in parallel and the temperature-sensitive resistor NTC form a voltage divider for current supply to the base.

The resistor R2 serves for limiting the current in the lower temperature range and thus, deforms the current curve of the side branch. Using R1 a branch current for current supply to the transistor base and the voltage level are adjusted in dependency of the existing voltage.

The NTC causes switching-off the current in the branch circuit at high temperatures. At lower temperatures the current amplification of the transistor has a current-limiting effect with correspondingly low currents through the side branch.

The entity T1-R3-R4 represents the current regulation unit. The transistor is to switch great currents. For this reason the linear current amplification factor represents an essential variable.

The two resistors R5 and R6 cause the current limiting at temperatures of 40° to 20-30° and consume most of the power. For this reason a transistor with low power (0.5 W) can be used.

But the resistors have the disadvantage that the dimensioning, where necessary, may require a great area. Alternatively a transistor with higher power can be adopted, and the resistor may be omitted completely or the design can be performed in a manner that no current limiting is performed and only a portion of the power will be consumed.

Figure 4:
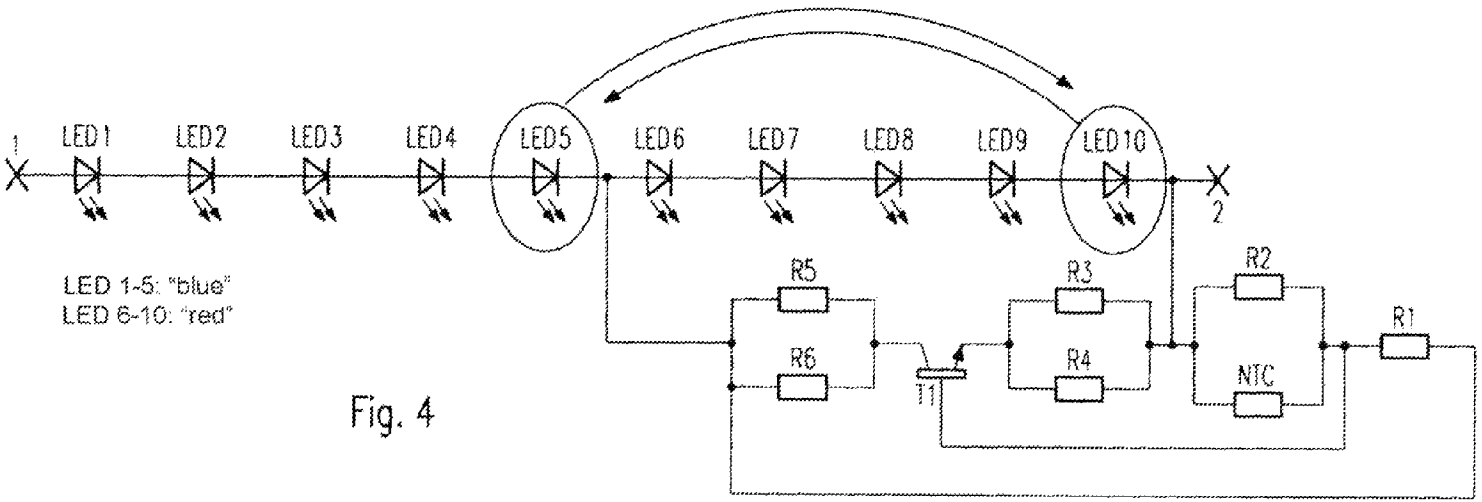
FIG. 4 shows a basic circuit arrangement as in FIG. 3 with the difference that a red LED of the chain of LEDs LED 6-10 is exchanged for a blue LED of the chain of LEDs LED 1-5.

FIG. 4 shows another embodiment derived from FIG. 3, but having a red LED connected in the chain of blue LEDs within the LED chain by an exchange.

Thus, the compensation ratio of the compensation circuit is changed, since the compensation current does not any more relate to the red LEDs only but also to one blue LED.

Thus, the compensation can be adjusted to the desired temperature behaviour that in addition to the resistor circuitry, the properties of the NTC/PTC and of the transistor amplification the arrangement of the differently coloured LEDs in the LED branch is changed as well. Herewith it is particularly important which LEDs are present following to the branching point for the compensation circuit. In the said modification there are not only LEDs of the same colour following to the branching point but there is at least one LED of a different colour present in the rest branch.

A particular field of application for such a temperature-compensated circuit are once again retrofit LED lamps.

Figure 5:
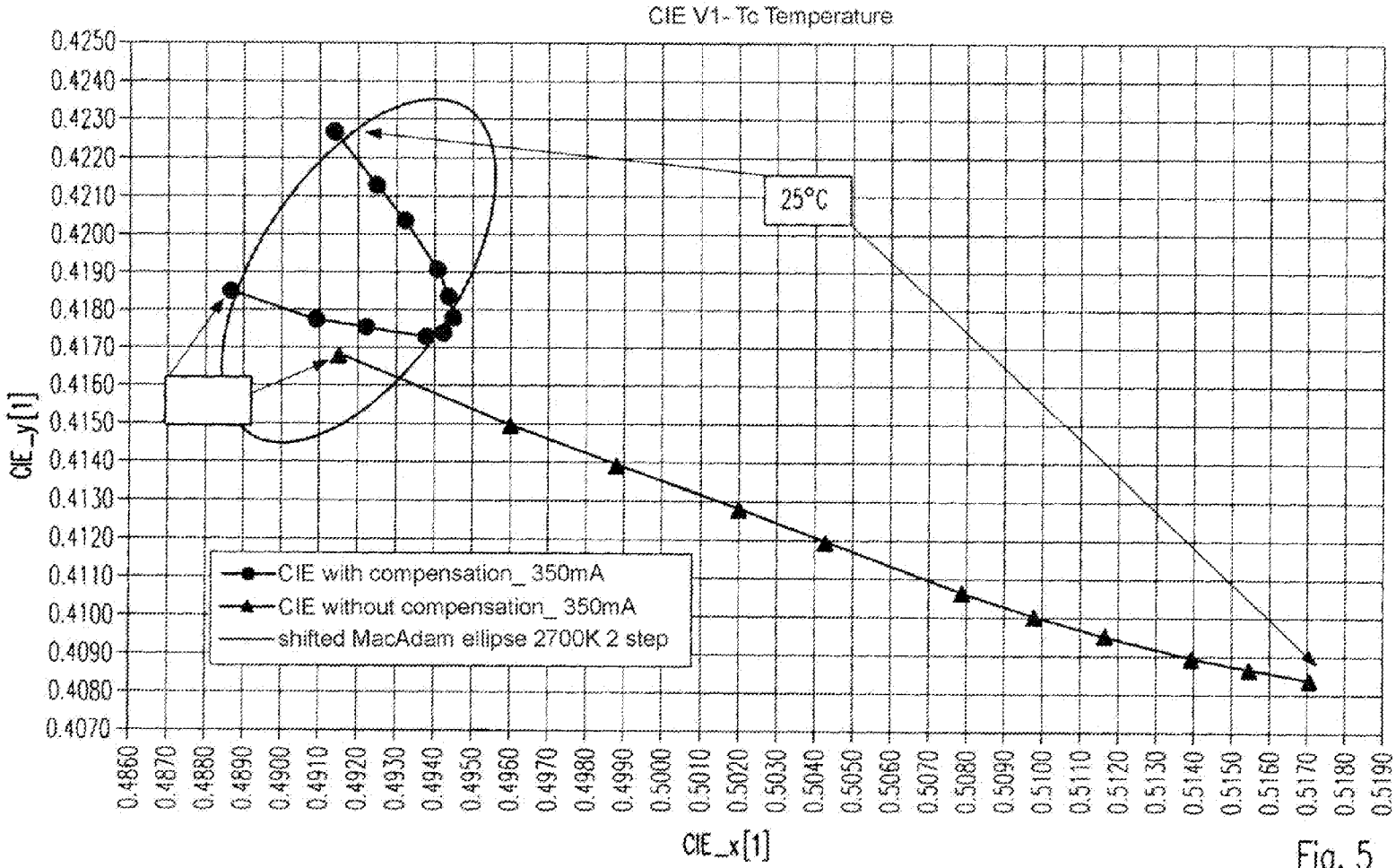
FIG. 5 shows CIE coordinates for different light fluxes of the circuit arrangement according to FIG. 4 in dependency of the temperature present at the temperature-sensitive NTC resistor.

FIG. 5 shows CIE colour coordinates for different compensation currents in dependency of the temperature TC at the temperature-dependent NTC in steps of 5 degrees. A typical temperature curve from 25 degrees to 85 degrees shows that the colour locus in the CIE chart stays within a predetermined McAdam ellipse of a defined colour temperature (e.g. 2700 Kelvin) in the course of a warming up.

The McAdam ellipse shows the tolerance range of the human eye for a predetermined point in the CIE chart. Thus, as the colour locus can be maintained within a McAdam ellipse by the compensation circuit the human eye does not perceive a colour change.

To attain this effect it is necessary to adjust the compensation current by dimensioning the resistors and/or the current amplification power of the transistor T1 in the compensation branch and, on the other hand, to adjust accordingly the arrangement (distribution of the red or blue LEDs) as shown in FIG. 4.

The temperature compensation obviously functions for different compensation currents, too, but due to the differing branch current in relation to the total current a shift towards red occurs for higher currents.

For lower temperatures up to 60° the compensation is even better than in the configuration according to FIG. 3 not having exchanged LEDs, but subsequently a strong shift occurs and the compensation is not sufficient any more. To counteract in this case there would have to be achieved a sharper drop up to 75° to a branch current of approximately 0 mA.

The invention claimed is:

1. Method for operating a range of LEDs, which range of LEDs generates mixed light with at least two LED types of different spectrum connected in series, wherein the movement of the colour locus of the mixed light, which is caused by the different negative gradients of the temperature dependencies of the intensity of at least two different LED types, is reduced by circuitry without using measurements and feedback variables, wherein a compensation for the different negative gradients of the temperature dependencies of the intensity is achieved by a circuit branch which is passive and in parallel to at least a portion of the range of LEDs, the current curve of which has an essentially inverse temperature gradient regarding to the intensity variation to be compensated for, wherein the circuit branch comprises at least one passive temperature-dependent component, that is a part of a network for controlling a transistor, the base-emitter path of which is within the circuit branch, and wherein the passive temperature-dependent component is provided in parallel to the base-collector path of the transistor, so as to achieve the essentially inverse temperature gradient regarding to the intensity variation to be compensated for.

2. The method according to claim 1, wherein the circuit branch comprises a PTC and/or NTC resistor.

3. The method according to claim 1, wherein the circuit branch is connected in parallel to a portion of the range of LEDs including only one type of LEDs or including several different types of LEDs.

4. The method according to claim 1, wherein the first LED type (LED(r)) is an optionally colour-converted red, amber-coloured, orange or infra-orange LED.

5. The method according to claim 1, wherein the second LED type (LED(b)) is an optionally colour-converted blue light LED or UV-light LED.

6. An operating circuit for a range of LEDs, which range of LEDs comprises at least two LED types of different spectrum connected in series for producing mixed light, comprising: a compensation circuit for reducing the movement of the colour locus of the mixed light, which is caused by the different negative gradients of the temperature dependencies of the intensity of the at least two different LED types, wherein the compensation circuit comprises a circuit branch passive and connected in parallel to at least a portion of the range of LEDs, the current curve of which has an essentially inverse temperature gradient regarding the intensity variation to be compensated for, wherein the circuit branch comprises at least one passive temperature-dependent component, that is a part of a network for controlling a transistor, the base-emitter path of which is within the circuit branch, and wherein the passive temperature-dependent component is provided in parallel to the base-collector path of the transistor, so as to achieve the essentially inverse temperature gradient regarding to the intensity variation to be compensated for.

7. The operating circuit according to claim 6, wherein the circuit branch comprises a PTC and/or NTC resistor.

8. The operating circuit according to claim 6, wherein the circuit branch is connected in parallel to a portion of the range of LEDs including only one type of LEDs or including several different types of LEDs.

9. The operating circuit according to claim 6, wherein the first LED type (LED(r)) is an optionally colour-converted red, amber-coloured, orange or infra-orange LED.

10. The operating circuit according to claim 6, wherein the second LED type (LED(b)) is an optionally colour-converted blue light LED or UV-light LED.

11. An LED module, comprising an operating circuit according to claim 6 and a range of LEDs fed by the operating circuit.

12. An LED lamp, in particular for white light, particularly a retrofit LED lamp, comprising at least one LED module according to claim 11.

* * * * *